US006363917B1

(12) United States Patent
Hopley

(10) Patent No.: US 6,363,917 B1
(45) Date of Patent: Apr. 2, 2002

(54) FUEL INJECTOR PUMP ADVANCE ARRANGEMENT

(75) Inventor: Daniel Jeremy Hopley, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/521,707

(22) Filed: Mar. 9, 2000

(30) Foreign Application Priority Data

Mar. 10, 1999 (GB) ..... 9905339

(51) Int. Cl.[7] ..... F02M 37/04
(52) U.S. Cl. ..... 123/502; 123/449
(58) Field of Search ..... 123/502, 501, 123/500, 449

(56) References Cited

U.S. PATENT DOCUMENTS 4,037,573 A * 7/1977 Swift ..... 123/500
4,329,962 A * 5/1982 Johnston ..... 123/502
4,408,591 A * 10/1983 Nakamura ..... 123/502
4,432,327 A * 2/1984 Salzgeber ..... 123/502
4,526,154 A * 7/1985 DiDomenico ..... 123/502
4,557,240 A * 12/1985 Sakuranaka ..... 123/502
4,594,989 A * 6/1986 Laufer ..... 123/502
4,610,234 A * 9/1986 Sakuranaka ..... 123/502
5,647,327 A * 7/1997 Enomoto et al. ..... 123/502

* cited by examiner

*Primary Examiner*—Carl S. Miller
(74) *Attorney, Agent, or Firm*—Timothy A. Twomey

(57) ABSTRACT

An advance arrangement for a fuel injection pump, comprising a housing slidably receiving an advance piston which, in use, cooperates with the fuel injection pump to adjust the timing of fuel delivery by the pump, and, a light load piston associated with the advance piston, the housing supporting an externally accessible, adjustable abutment which cooperates with the light load piston to permit setting of a rest position of the light load piston relative to said housing and thereby to permit adjustment, from the exterior of said housing, of the datum setting from which the advance arrangement adjusts fuel injection timing.

2 Claims, 3 Drawing Sheets

FUEL INJECTOR PUMP ADVANCE ARRANGEMENT

TECHNICAL FIELD

This invention relates to an advance arrangement for use in controlling the timing of fuel delivery by a high pressure fuel injection pump intended for use in conjunction with a compression ignition internal combustion engine. More specifically the invention relates to an advance arrangement including, inter alia, a light load advance mechanism.

BACKGROUND OF THE INVENTION

Although the advance arrangement associated with the fuel injection pump can adjust the timing of fuel injection in accordance, inter alia, with light load operating conditions of the associated internal combustion engine, the adjustment of a datum timing setting in relation to which adjustment by the advance arrangement takes place, is achieved by physically securing the pump to the associated engine in a predetermined angular location in relation to the pump drive mechanism. Accordingly, adjustment of the datum position is particularly inconvenient, and may be extremely difficult and time consuming in that the engine must be run, and then stopped to permit datum adjustment, and in many installations access to the pump mounting flange in order to effect adjustment of the physical position of the pump relative to the engine, is restricted.

SUMMARY OF THE INVENTION

It is an object of the present invention to provide an advance arrangement for a fuel injection pump in which the aforementioned difficulty is minimised or obviated.

In accordance with the present invention there is provided an advance arrangement for a fuel injection pump, the arrangement including a housing slidably receiving an advance piston which, in use, cooperates with the fuel injection pump to adjust the timing of fuel delivery by the pump, and, a light load piston associated with the advance piston, the housing supporting an externally accessible, adjustable abutment which cooperates with the light load piston to permit setting of a rest position of the light load piston relative to said housing and thereby to permit adjustment, from the exterior of said housing, of the datum setting from which the advance arrangement adjusts fuel injection timing.

Preferably said externally accessible, adjustable abutment is rotatable about a first axis, and includes a stop member positioned eccentrically with respect to said first axis, said stop member cooperating with said light load piston such that rotation of said adjustable abutment relative to the housing adjusts the rest position of said light load piston relative to the housing.

Preferably the axis of rotation of said adjustable abutment is at right angles to, and intersects, the axis of longitudinal movement of the light load piston.

Desirably there is provided a locking device operable to lock the abutment relative to said housing.

In a preferred embodiment a servo-piston is slidable in a bore provided in the advance piston, said light load piston is moveable relative to the advance piston against the action of a light load control spring, a servo control spring is engaged between the light load piston and the servo-piston, a light load control valve is operable to control the application of fuel to the light load piston to adjust timing under light load conditions, and an independent temperature control valve is operable to control the application of fuel to the light load piston depending upon the engine temperature to permit adjustment of the timing of fuel delivery to compensate for cold conditions.

BRIEF DESCRIPTION OF THE DRAWINGS

One example of the invention is illustrated in the accompanying drawings, wherein.

DESCRIPTION OF THE PREFERRED EMBODIMENT

Figure 1:
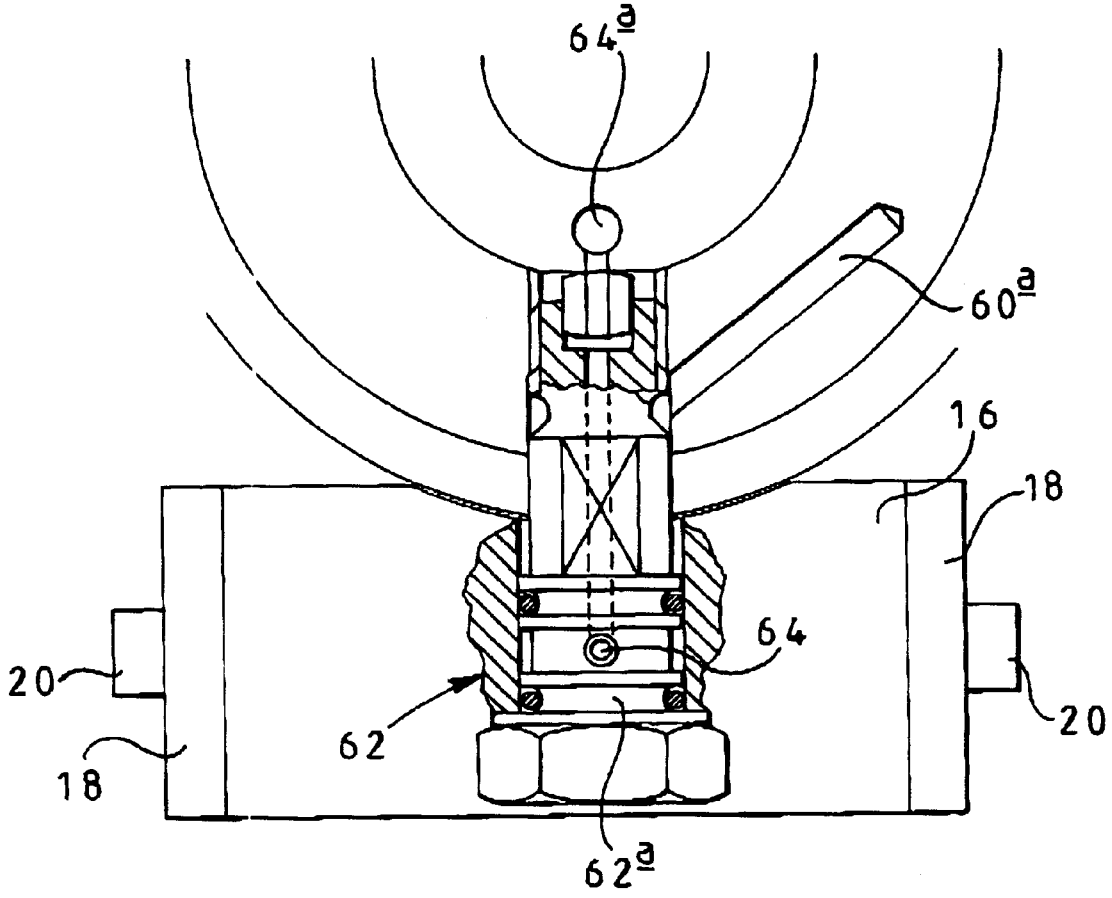
FIG. 1 is a diagrammatic cross-sectional view of part of a high pressure fuel injection pump of a compression ignition internal combustion engine incorporating a servo-type advance arrangement including light load and cold advance features.

Referring to the drawings, the advance forms part of a high pressure, rotary fuel pump of generally known form which includes a cam ring angularly adjustable with respect to the housing of the pump, and incorporating a plurality of cam lobes. The cam ring encircles part of a distributor member which includes pumping plungers reciprocable within respective bores of the distributor member, the plungers having associated therewith respective shoe and roller arrangements the rollers of which are engageable with the cam surface of the cam ring. In use, fuel is supplied to the bores of the distributor member by a transfer pump, pushing the plungers thereof radially outwards. The output pressure of the transfer pump is controlled so as to be related to the speed of operation of the engine with which the pump is being used. Rotation of the distributor member relative to the cam ring causes the rollers to move relative to the cam ring, engagement of the rollers with the cam lobes causing the plungers to be forced inwards, pressurizing the fuel within the bores, and causing fuel to be delivered by the fuel pump at high pressure. Clearly, by altering the angular position of the cam ring, the timing at which fuel is delivered by the pump can be adjusted.

Figure 2:
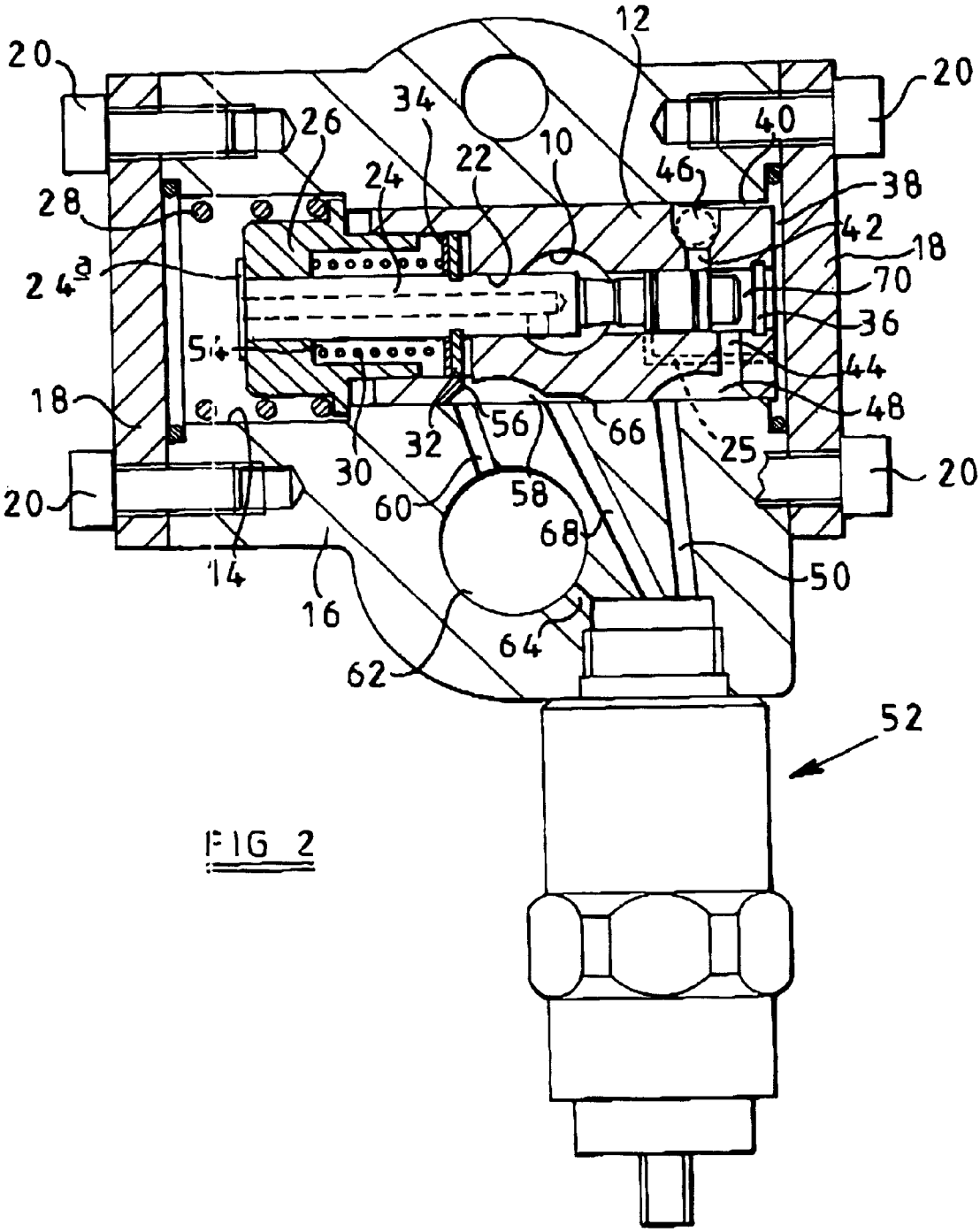
FIG. 2 is a diagrammatic cross-sectional view of part of the servo-type advance arrangement illustrated in FIG. 1.

In order to permit adjustment of the angular position of the cam ring, the cam ring is provided with a peg which extends into an opening 10 (FIG. 2) provided in an advance piston 12 which is slidable within a bore 14 provided in a cam box housing 16. The ends of the bore 14 are closed by end plates 18 which are secured to the cam box housing 16 by means of bolts 20, appropriate O-rings being used to seal the end plates 18 to the housing 16.

The advance piston 12 includes an axially extending bore 22 within which a servo-piston member 24 is slidable. A light load piston 26 is also received within the bore 14, the light load piston 26 including a central opening through which the servo-piston 24 extends, the servo-piston 24 acting to guide movement of the light load piston 26, the servo-piston 24 being a substantially fluid tight, sliding fit within the opening of the light load piston 26 and within the bore 22 of the advance piston 12. A light load control spring 28 is engaged between the light load piston 26 and one of the plates 18 to bias the light load piston 26 into engagement with a step defined by part of the bore 14.

A servo control spring 30 is engaged between the light load piston and an annular member 32 which is carried by the servo-piston 24. As illustrated in FIG. 1, a shim 34 is located between the spring 30 and annular member 32. The shim 34 acts to control the maximum permitted movement of the servo-piston towards the light load piston 26 (movement to the left in FIG. 2), the movement being limited by the engagement of the shim 34 with an end surface of the light load piston 26. The end of the servo-piston 24 protruding through the light load piston 26 is formed with a head 24*a* which engages the outer end surface of the piston 26 to limit inward movement of the piston 24 relative to the piston 26 (movement to the right in FIG. 2).

The end of the bore 22 remote from the light load piston 26 is closed by means of a disk-shaped member 36 which is located within an annular groove formed in the advance piston 12, the location of the member 36 being achieved, for example, using an appropriate thermal expansion technique. Alternatively, the bore may be closed by means of a core plug, bolt or the like. Clearly, movement of the servo-piston 24 relative to the advance piston 12 is limited by engagement of an end of the servo-piston 24 with the member 36.

A first control chamber 38 is defined by an end face of the advance piston 12 remote from the light load piston 26, the associated part of the bore 14, and the associated end plate 18. The first control chamber 38 communicates via a channel 40 formed in the outer periphery of the advance piston 12 with a radially extending passage 42 within which a non-return valve 46 is located. The radially extending passage 42 communicates with the bore 22, and depending upon the position of the servo-piston 24, the radially extending passage 42 may communicate with a second radially extending passage 44 which opens into a recess 48 provided in the outer surface of the advance piston 12. The recess 48 is located so that for all permitted positions of the advance piston 12 relative to the housing 16, the recess 48 communicates with a passage 50 which communicates with a chamber defined between the housing 16 and an electromagnetically operated temperature control valve 52 mounted upon the housing 16, the chamber communicating constantly with a bore 64 which communicates with a bore 62.

The advance piston 12 and light load piston 26 together define a second control chamber 54 within which the spring 30 is located, the second control chamber 54 communicating with a radially extending passage 56 which opens into a recess 58 provided in the outer surface of the advance piston 12. The recess 58 is located so that for all permitted positions of the advance piston 12, the recess 58 communicates with a passage 60 which communicates with the bore 62. The bore 62 contains a passage defining member 62*a* (FIG. 1) which ensures that the bore 64 communicates, constantly, with a passage 64*a* containing fuel at transfer pressure, and the passage communicates with a drilling 60*a* which communicates with a metering valve.

Extending from the recess 58, the outer surface of the advance piston 12 is provided with a short flat 66 which, depending upon the axial position of the advance piston 12, is arranged to communicate with a passage 68 which communicates with the temperature control valve 52.

Under normal operating conditions, where the engine is hot and the engine load is reasonably high, the temperature control valve 52 is switched so that fuel at transfer pressure is supplied through the passage 64 to the passage 50, but is not supplied to the passage 68. Further, the metering valve supplies fuel at low pressure to the passage 60. In these conditions, the fuel pressure within the second control chamber 54 is relatively low, thus the light load piston 26 is biased by means of the spring 28 into engagement with the shoulder of the bore 14 as illustrated. Fuel at transfer pressure is supplied through the passage 50, recess 48 and passage 44 to a chamber 70 defined by the bore 22 of the advance piston 12, the end of the servo-piston 24 and the member 36. In the position shown, the servo-piston 24 occupies a position in which communication between the chamber 70 and the radially extending passage 42 is not permitted. However, should the speed of rotation of the engine increase resulting in an increase in the transfer pressure, the fuel pressure within the chamber 70 may increase to a sufficient extent to cause movement of the servo-piston 24 against the action of the spring 30 to a position in which communication between the chamber 70 and radially extending passage 42 is permitted. In these circumstances fuel flows from the chamber 70 through the radially extending passage 42 and past the non-return valve 46 to the first control chamber 38. The flow of fuel to the chamber 38 increases the pressure therein, applying a force to the advance piston 12 causing the piston 12 to move towards the left in the orientation illustrated in FIG. 2. Movement of the advance piston 12 in this direction causes movement of the cam ring, due to the cooperation of the peg with the opening 10, to advance the timing of fuel delivery by the pump.

It will be appreciated, in use, that at the instant at which the rollers move into engagement with the cam lobes provided on the cam ring, a significant force is transmitted through the cam ring and peg to the advance piston 12, tending to move the advance piston 12 towards the right in the orientation illustrated. Clearly such movement would tend to increase the fuel pressure within the control chamber 38, and the non-return valve 46 is provided in order to avoid the increase in fuel pressure within the chamber 38 resulting in fuel flow in the reverse direction.

Once the movement of the advance piston 12 results in the passage 42 being closed by the servo-piston 24, the supply of fuel to the chamber 38 is terminated and movement of the advance piston in this direction ceases.

Clearly, in circumstances in which it is desirable to retard the timing of fuel delivery by the pump, the advance piston 12 must move towards the right in the orientation illustrated. In such circumstances, the transfer pressure falls, thus the servo-piston 24 moves towards the right. Movement of the servo-piston 24 relative to the advance piston 12 beyond a predetermined position results in a drain passage 25 being uncovered permitting fuel to escape from the control chamber 38 to the cam box of the high pressure fuel pump. The fuel pressure within the control chamber 38 thus falls, resulting in movement of the advance piston 12 to the right. Movement of the advance piston ceases upon the advance piston having moved to a position in which the drain passage 25 is closed by the servo-piston.

It is intended that the maximum permitted advance is relatively low. In practice the maximum advance is limited by the engagement of the end of the advance piston 12 remote from the control chamber 38 with the light load piston 26.

Turning to the condition where the engine is operating at a relatively light load, the engine being hot, in these conditions the metering valve allows the pressure applied to the passage 60 to rise. The fuel pressure applied to the second control chamber 54 hence rises. The application of fuel at increased pressure to this chamber results in movement of the light load piston 26 against the action of the spring 28. Clearly such movement of the light load piston 26 reduces the compression of the spring 30, and the application of fuel to the chamber 70 as described hereinbefore causes movement of the servo-piston 24 to the left in the orientation illustrated. As described hereinbefore, the movement of the servo-piston 24 permits fuel to flow to the first control chamber 38 resulting in movement of the advance piston 12 to the left, advancing the timing of fuel delivery by the pump.

It will be understood that moving the light load piston 26 has an effect upon the relationship between engine speed and the rate of adjustment of timing of fuel delivery by the pump, and also as the light load piston 26 is moved, the maximum permitted level of advance is also increased.

For both of the operating conditions described hereinbefore, the temperature control valve 52 may be switched in order to adjust timing to compensate for the engine being cold. The effect of switching the temperature control valve 52 is that fuel at transfer pressure is supplied to the passage 68. In the position illustrated in FIG. 2, fuel from the passage 68 flows through the flat 66 to the recess 58 and from there to the second control chamber 54. The application of fuel to the second control chamber 54 results in movement of the light load piston 26, and described hereinbefore, this results in adjustment of the position of the advance piston 12. Assuming, firstly, that the engine is running at high load, thus fuel is not being supplied through the passage 60 to the second control chamber 58, then after a predetermined movement of the advance piston 12, the passage 68 no longer registers with the flat 66, thus further fuel is no longer permitted to flow to the second control chamber 54. This break in communication results in movement of the light load piston 26 to the left in the orientation illustrated being limited. However, should the engine be operating at light load conditions, fuel is able to flow through the passage 60 to the second control chamber 54, thus movement of the light load piston 26 to the left continues.

The provision of such an advance arrangement has the advantage that the high load conditions can operate over an increased pressure range, thus permitting an increase in the stiffness of the spring 30 resulting in greater stability and more consistent operation. The light load advance condition can also operate over a larger pressure range without interfering with the operation of the advance arrangement under full load conditions. As separate springs are used to control the operation under full load and light load, the characteristics of these springs can be optimized for the pump with which the advance arrangement is to be used. Also, as, at full load, movement of the servo-piston 24 is limited by engagement with the light load piston 26, the maximum advance position of the advance piston 12 is well defined, and operation of the engine under these conditions is more stable.

Clearly, by altering the length of the flat 66, the maximum advance under cold conditions at full load can be controlled independently of the other operating characteristics of the arrangement. Under low load conditions, the length of the flat 66 is of less importance as the position of the low load piston 26 is determined by the pressure of fuel supplied through the passage 60 to the second control chamber 54 under these conditions.

Conveniently, the temperature control valve 52 takes the form of a conventional stop solenoid which is supplied with electrical current only when the engine is at low temperature. Clearly, should the temperature control valve 52 fail, then it is likely to fail in the high temperature condition. This has the advantage that breaking the supply to the condition valve 52 does not result in improved performance of the engine at the expense of emissions, thus reducing the risk of tampering.

Although the description hereinbefore is of a fuel pump of the type in which pumping plungers move in a radial direction in order to supply fuel at high pressure to an engine, it will be appreciated that the advance arrangement may be applicable to other types of high pressure fuel pump.

Additional information relating to the above mentioned advance arrangement are described in our co-pending U.S. patent application Ser. No. 09/196,082 which is incorporated herein by reference.

Although the advance arrangement described above provides for advancing and retarding of the timing of the point in the engine cycle at which fuel is injected into the associated internal combustion engine, there remains the problem of establishing a datum timing position in relation to which adjustment of the timing is effected by the advance arrangement.

Conventionally setting of the timing datum for fuel injection is effected by adjusting the physical position of the pump housing relative to the internal combustion engine about the axis of rotation of the drive arrangement for the pump. In essence the pump housing is adjusted angularly about the axis of rotation of the pump drive arrangement and is then clamped in an adjusted position by bolts which secure the pump housing to the internal combustion engine. As mentioned above such an arrangement is disadvantageous and FIG. 3 illustrates a modification of the advance arrangement described above in which adjustment of the timing datum can be effected simply and conveniently.

Figure 3:
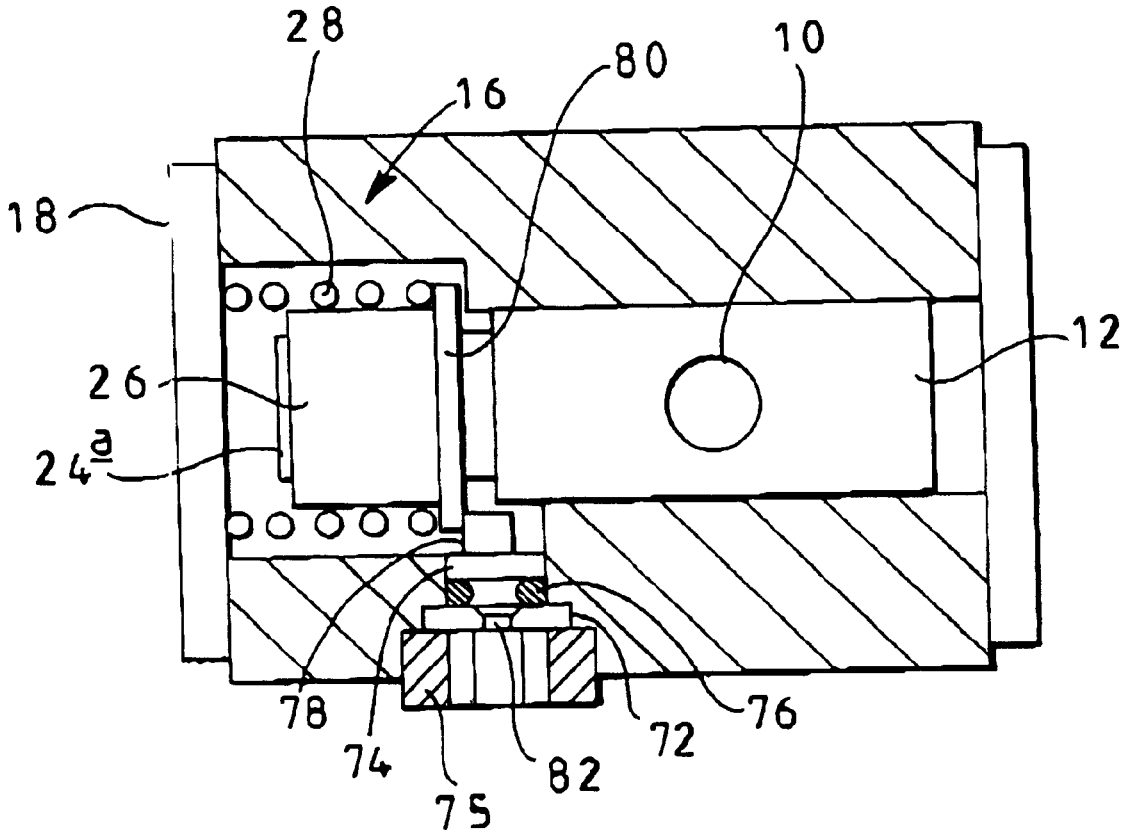
FIG. 3 is a diagrammatic cross-sectional view of part of the arrangement illustrated in FIG. 2 and depicting an externally accessible adjustable abutment for setting the timing datum of the associated pump in use.

It can be seen in FIG. 3 that the wall of the housing 16 is formed with a stepped transverse bore 72 within which an abutment member 74 is rotatably received. The abutment member 74 is retained in an inner narrower region of the bore 72 by a locking ring 75 in screw-threaded engagement with the wall of an outer wider region of the bore 72 and the rotating interface of the member 74 and the bore 72 is sealed by an O-ring seal 76 carried in a groove of the member 74 and engaging the plain wall of said inner region of the bore 72.

The axis of rotation of the member 74 extends at right angles to, and intersects the common longitudinal axis of the light load piston 26 and the advance piston 12 and the member 74 includes an eccentric post 78 which projects parallel to the axis of the member 74 and is engageable with one face of a radially outwardly extending circumferential flange 80 of the light load piston 26, the opposite face of which forms a seating receiving one end of the light load control spring 28.

The post 78 is of circular cross-section and its axis is parallel to, but spaced laterally from, the axis of rotation of the remainder of the member 74. The post 78 forms an abutment against which the flange 80 engages under the action of the spring 28, and thus defines the rest position of the light load piston 26 (and, by virtue of the spring 30 and the head 24*a*, the rest position of the piston 24) relative to the housing 16 and the advance piston 12. Rotation of the member 74 in the housing 16 adjusts the axial location of the rest position of the light load piston 26 and the servo-piston 24. The outer end of the member 74, which is accessible from the exterior of the housing 16 through the central aperture of the locking ring 75, is provided with a recess 82 shaped for receiving an adjustment tool.

The timing datum for the pump with which the advance arrangement is associated is defined by the rest position of the light load piston within the housing 16, and thus rotation of the member 74 through an appropriate 180° arc displaces the rest position of the light load piston 26 between maximum and minimum positions. The actual distance between the maximum and minimum positions is of course determined by the eccentricity of the post 78 relative to the axis of rotation of the member 74 and conveniently the eccentricity can be of the order of 0.4 mm giving a total "throw" of 0.8 mm and thus an adjustment of the datum position of plus or minus 0.4 mm from a central position of the adjustable abutment member 74.

In use, the advance arrangement will be assembled with the member 74 in its intermediate position so that after the adjuster and injection pump have been assembled to the associated internal combustion engine the member 74 can be turned in one direction or the other to give the appropriate adjustment of the timing datum without the need to physically alter the position of the pump housing relative to the internal combustion engine. (It being assumed that the maximum adjustment needed in datum will be achieved by plus or minus 0.4 mm).

It will be recognised that if desired the eccentric post 78 could be replaced by some form of cam shaping at the inner end of the member 74 to cooperate with the piston 26 to achieve a desired range and characteristic of adjustment. After adjustment the member 74 is locked in its adjusted position relative to the housing by screwing the locking ring 75 inwardly to clamp a peripheral shoulder of the member 74 against a shoulder defined by a stepped region of the bore 72, the central aperture of the ring 75 conveniently being hexagonal to receive and cooperate with a tightening tool.

What is claimed is:

1. An advance arrangement for a fuel injection pump, comprising a housing slidably receiving an advance piston which, in use, cooperates with the fuel injection pump to adjust the timing of fuel delivery by the pump, and, a light load piston associated with the advance piston, the housing supporting an externally accessible, adjustable abutment which cooperates with the light load piston to permit setting of a rest position of the light load piston relative to said housing and thereby to permit adjustment, from the exterior of said housing, of the datum setting from which the advance arrangement adjusts fuel injection timing, wherein said externally accessible, adjustable abutment is rotatable about a first axis, and includes a stop member positioned eccentrically with respect to said first axis, said stop member cooperating with said light load piston such that rotation of said adjustable abutment relative to the housing adjusts the rest position of said light load piston relative to the housing and wherein the axis of rotation of said adjustable abutment is at right angles to, and intersects, the axis of longitudinal movement of the light load piston.

2. An advancement arrangement, comprising a housing slidably receiving an advance piston which, in use, cooperates with the fuel injection pump to adjust the timing of fuel delivery by the pump, and, a light load piston associated with the advance piston, the housing supporting an externally accessible, adjustable autment which cooperates with the light load piston to permit setting of a rest position of the light load piston relative to said housing and thereby to permit adjustment, from the exterior of said housing, of the datum setting from which the advance arrangement adjusts fuel injection timing; and wherein a servo-piston is slidable in a bore provided in the advance piston, said light load piston is moveable relative to the advance piston against the action of a light load control spring, a servo control spring is engaged between the light load piston and the servo-piston, a light load control valve is operable to control the application of fuel to the light load piston to adjust timing under light load conditions, and an independent temperature control valve is operable to control the application of fuel to the light load piston depending upon the engine temperature to permit adjustment of the timing of fuel delivery to compensate for cold conditions.

* * * * *